US011312126B2

(12) United States Patent
Hoschke et al.

(10) Patent No.: US 11,312,126 B2
(45) Date of Patent: Apr. 26, 2022

(54) METHOD OF GENERATING ALIGNMENT DATA FOR PRINTHEADS

(71) Applicant: MEMJET TECHNOLOGY LIMITED, Dublin (IE)

(72) Inventors: Nigel Hoschke, North Ryde (AU); Rodney Hardy, North Ryde (AU); Steven Parker, North Ryde (AU)

(73) Assignee: Memjet Technology Limited

( * ) Notice: Subject to any disclaimer, the term of this patent is extended or adjusted under 35 U.S.C. 154(b) by 49 days.

(21) Appl. No.: 16/736,348

(22) Filed: Jan. 7, 2020

(65) Prior Publication Data

US 2020/0223221 A1 Jul. 16, 2020

Related U.S. Application Data

(60) Provisional application No. 62/790,883, filed on Jan. 10, 2019.

(51) Int. Cl.

| | |
|---|---|
| ***B41J 2/045*** | (2006.01) |
| ***B41F 33/00*** | (2006.01) |
| ***B41J 29/393*** | (2006.01) |

(52) U.S. Cl.

CPC ..... *B41J 2/04505* (2013.01); *B41F 33/0081* (2013.01); *B41J 29/393* (2013.01); *B41J 2029/3935* (2013.01); *B41J 2202/20* (2013.01)

(58) Field of Classification Search

CPC ..... B41J 29/393; B41J 2029/3935; B41J 2202/20; B41J 2/04505; B41J 2/2135;

(Continued)

(56) References Cited

U.S. PATENT DOCUMENTS

2010/0214347 A1 8/2010 Sasayama
2013/0220157 A1 8/2013 Heng (Continued)

FOREIGN PATENT DOCUMENTS

JP 2008-068536 A 3/2008
WO WO-2016/029925 A1 3/2016
WO WO-2016/158033 A1 10/2016

OTHER PUBLICATIONS

International Search Report dated Mar. 20, 2020, for PCT Application No. PCT/EP2019/085207, filed on Dec. 13, 2019, 5 pages.

(Continued)

*Primary Examiner* — Jannelle M Lebron
(74) *Attorney, Agent, or Firm* — Cooley LLP

(57) ABSTRACT

A method of generating alignment data for a printhead. The method includes the steps of: printing a calibration pattern using the printhead, the calibration pattern including rows of spaced apart fiducials, each fiducial having a plurality of concentric shapes representing a code sequence; imaging the fiducials at a first resolution to generate imaged fiducials; cross-correlating a template fiducial with the imaged fiducials at a plurality of different displacement s relative to each imaged fiducial, the template fiducial having a configuration matching the imaged fiducials; determining a two-dimensional set of cross-correlation values for each imaged fiducial, each set of cross-correlation values indicating a center of a respective fiducial; and generating alignment data for the printhead using the sets of cross-correlation values.

19 Claims, 6 Drawing Sheets

(58) Field of Classification Search
CPC ... B41J 29/38; B41J 11/46; B41J 11/42; B41J 19/145; B41F 33/0081
See application file for complete search history.

(56) References Cited

U.S. PATENT DOCUMENTS

2015/0125053 A1 5/2015 Vieceli et al.
2017/0341371 A1* 11/2017 Muth ..... B41J 29/393

OTHER PUBLICATIONS

Written Opinion of the International Searching Authority dated Mar. 20, 2020, for PCT Application No. PCT/EP2019/085207, filed on Dec. 13, 2019, 7 pages.

* cited by examiner

METHOD OF GENERATING ALIGNMENT DATA FOR PRINTHEADS

CROSS-REFERENCE TO RELATED APPLICATIONS

This application claims the benefit of U.S. Provisional Application No. 62/790,883, filed Jan. 10, 2019, entitled METHOD OF GENERATING ALIGNMENT DATA FOR PRINTHEADS, which is incorporated herein in its entirety.

FIELD OF THE INVENTION

The present invention relates generally to a method of generating alignment data for printheads. It has been developed primarily for electronically correcting misalignments in multiple printheads containing multiple print chips.

BACKGROUND OF THE INVENTION

Pagewide printing dramatically increases print speeds compared to traditional scanning printheads. The Applicant has developed many different types of pagewide printers employing fixed printheads or print modules. For example, US 2017/0313061 (the contents of which are incorporated herein by reference) describes a printing system having multiple monochrome pagewide print bars, each print bar having a staggered overlapping array of monochrome printheads ("print modules"). Each printhead itself typically contains multiple print chips, which may be butted together, as described in, for example, U.S. Pat. No. 9,950,527 (the contents of which are incorporated herein by reference) or arranged in a staggered overlapping array, as described in, for example, U.S. Pat. No. 8,662,636 (the contents of which are incorporated herein by reference).

A problem in any printing system is misalignment of nozzles across the length of the printhead. Ideally, all nozzles are positioned in a perfect linear row across a media feed path (nominally an x-axis) and have a consistent separation along a media feed direction (nominally a y-axis) for perfect dot-on-dot printing. In practice, however, all printheads suffer, at least to some extent, from nozzle misalignments, which affect print quality. Misalignments are a perennial problem in pagewide printing systems using elongate high-resolution printheads. Even in single printhead systems, printheads may warp or bow along their length due to thermal expansion. Additionally, the printhead may be skewed relative to the media feed path, especially in printing systems having replaceable printheads. Furthermore, individual print chips within a printhead may be misplaced (e.g. skewed) during printhead fabrication resulting in nozzle misalignments.

Misalignment problems are exacerbated further in modular printing systems having overlapping print modules (e.g. US 2017/0313061). Overlapping print modules must be electronically stitched together to produce single rows of print, and nozzle misalignments in overlapping regions typically cause a visible reduction in print quality—manifested as either a dark or light strip down the page.

Misalignment problems are also exacerbated in modular printing systems having multiple monochrome printheads aligned along the media feed direction (e.g. US 2017/0313061 and US 2012/0092405, the contents of which are incorporated herein by reference). Monochrome printheads require a known spacing in order to achieve dot-on-dot printing and misalignments between the printheads (e.g. skewed printheads relative to a nominal reference printhead) inevitably causes a reduction in print quality.

Efforts to compensate for nozzle misalignments generally fall into two categories: mechanical alignment and electronic alignment. Mechanical alignment requires mechanically adjusting the physical position of each printhead (or print chip) to compensate for skew or other positioning errors. Mechanical alignment techniques have the advantage of permanent compensation at the factory but are less suitable for correcting alignment errors which occur in the field (e.g. during printhead replacement, during printhead maintenance cycles, warpage resulting from thermal expansion, change of print media etc.). On the other hand, electronic alignment adjusts the timings of nozzle firing to compensate for nozzle misalignments. Electronic alignment techniques have the advantages of correcting alignment errors in situ (e.g. after replacing a printhead, after a maintenance cycle, between different print jobs etc.) together with simpler, less expensive mechanical arrangements for mounting printheads and/or print chips.

Whichever method is used for compensating nozzle misalignments, alignment data must be generated in order to perform the appropriate compensation. Most printers print calibration patterns in order to generate the necessary alignment data and compensate for nozzle misalignments. Typically, calibration patterns use a series of horizontal and vertical printed lines to generate alignment data. For example, US 2012/0092405 prints a 2D Vernier calibration map to determine vertical and horizontal misalignments of printheads relative to a reference printhead via analysis of interference patterns.

There are several problems with prior art calibration patterns used for generating alignment data for high-resolution pagewide printheads. Firstly, optical scanners typically operate at an imaging resolution that is less than the printhead resolution. For example, an off-the-shelf flatbed scanner or inline optical sensor may have an imaging resolution of about 300 dpi, whereas a MEMS pagewide printhead typically has a native printing resolution of 800 dpi or more (e.g. 1600 dpi for a Memjet® printhead). Although some commercial scanners operate at higher resolutions, such scanners are expensive and, moreover, the amount of data generated becomes impractical in terms of the bandwidth required to transfer image data, and the time required to process the data. On the other hand, scanning at lower resolutions (e.g. 300 dpi) is not suitable for analyzing prior art calibration patterns at a resolution sufficient to optimize compensation of nozzle misalignments (either via mechanical or electronic compensation techniques).

Another problem with line-based prior art calibration patterns is that they are subject to rotational errors during optical scanning. Ideally, calibration patterns should be rotationally invariant enabling compensation for nozzle misalignments, even in the presence of skew errors in the imaging process.

A further problem with line-based prior art calibration patterns is that they generate a relatively small amount of alignment data per page. Typically, many pages of calibration patterns are required to generate a sufficient amount of alignment data, which is cumbersome in terms of both the printing and scanning required for each page.

A further problem with line-based calibration patterns is that they are susceptible to noise errors, either via dot spreading ("dot gain") during printing of the pattern and/or during the optical scanning process (e.g. as a result of non-uniformities in the glass bed of a flatbed scanner). Such noise errors inevitably reduce the accuracy of any subsequent compensation techniques used to improve print quality.

It would therefore be desirable to provide a method of generating alignment data suitable for high-resolution printheads, which addresses at least some of the above-mentioned problems associated with prior art methods.

SUMMARY OF THE INVENTION

In a first aspect, there is provided a method of generating alignment data for at least one printhead, the method comprising the steps of:

printing a calibration pattern onto a print medium using the printhead, the calibration pattern comprising one or more rows of spaced apart fiducials, each fiducial comprising a plurality of concentric shapes representing a code sequence;

imaging the fiducials at a first resolution to generate imaged fiducials;

cross-correlating a template fiducial with the imaged fiducials at a plurality of different displacements relative to each imaged fiducial, the template fiducial having a configuration matching the imaged fiducials;

determining a two-dimensional set of cross-correlation values for each imaged fiducial, each set of cross-correlation values indicating a center of a respective fiducial; and generating alignment data for the printhead using the sets of cross-correlation values.

As used herein, the term "printhead" means any printing device, including inkjet and laser printing devices. For example, the printhead may be an inkjet printing comprising a plurality of MEMS print chips mounted to a carrier substrate. Each printhead may comprise and array of butting or overlapping rows of print chips. Typically, the printhead is one of an array of printheads (or "print modules"), which may be overlapped to provide a printing width wider than one printhead. Additionally or alternatively, the printhead is one of any array of printheads aligned along a media feed direction for printing a same or different colored inks.

The method according to the first aspect advantageously employs two-dimensional concentric shapes as fiducials to generate alignment data. Concentric shapes are rotationally invariant; therefore, alignment data generated from the fiducials are not affected by any unintended skew in an optical imaging process—each fiducial provides a rotationally invariant location identifying the centerpoint of a respective fiducial. Preferably, the concentric shapes are circular (e.g. annuli), although it will be appreciated that other concentric shapes (e.g. polygons) may also be used.

In the method according to the first aspect, cross-correlation of a template fiducial ("kernel") with each printed fiducial at a plurality of different displacements yields a large set of data, which can be manipulated to provide an accurate centerpoint location for each fiducial. Preferably, the template fiducial ("kernel") is constructed virtually at a high resolution relative to the imaging resolution (e.g. a resolution matching the print resolution) and then low-pass filtered so as to simulate, as far as possible, the natural smearing or blurring of edges of the imaged fiducials through the printing and imaging process. Thus, low-pass filtering of the template fiducial optimizes the subsequent cross-correlation process.

Preferably, alignment data is generated by interpolating sets of cross-correlation values to generate rows of fiducial locations at a higher resolution than the imaging resolution. Thus, imaging at a relatively low resolution using, for example, an off-the-shelf flatbed scanner may be used to generate alignment data at an accuracy suitable for a relatively high resolution printhead, such as a Memjet® printhead.

A further advantage of the method according to the first aspect is that the effects of noise may be reduced through careful choice of a code sequence represented by the concentric shapes. In particular, code sequences having low cross-correlation characteristics are highly suitable for generating the alignment data, even in the presence of noise. Preferably, the code sequence is a Barker code, although other code sequences having low cross-correlation characteristics are equally suitable.

Preferably, the code sequence contains a sequence of N code values, each code value being represented by a presence or absence of an annulus at a predetermined distance from a center of the fiducial, wherein N is an integer from 3 to 20. More preferably, the code sequence is the Barker code: [+1, +1, +1, +1, +1, −1, −1, +1, +1, −1, +1, −1, +1]. Preferably, the code value +1 is represented by an absence of an annulus, and the code value −1 is represented by the presence of an annulus. Each concentric annulus necessarily has an increasing diameter away from the center of the fiducial, and neighboring annuli may be contiguous. It will be further appreciated that each annulus has a ring-width (defined by R−r, wherein R is an outer radius radius and r is an inner radius of the annulus) suitable for detection at the resolution of the imaging device. For example, the ring-width of each annulus may be at least 25 microns, 50 microns, at least 75 microns or at least 100 microns in order to be imageable by a conventional flatbed scanner.

Although the present invention has been developed for use with imaging systems having a relatively low resolution compared to the printhead resolution, it will of course be appreciated that the present invention may still be used with images captured at any imaging resolution. For example, the imaging resolution may be in the range of 250 to 5000 dpi, 250 to 1000 dpi or 250 to 800 dpi. Preferably, the imaging resolution is less than about 800 dpi in order to minimize equipment costs, data size, data transfer bandwidth and processing times.

Alignment data may be further optimized by using a second interpolation (e.g. bicubic interpolation) of the rows of locations provided by the first interpolation of the sets of cross-correlations values. Typically, each printhead may print, for example, 10-100 fiducials in one row providing a corresponding number of locations for use in generating alignment data. However, interpolation of the fiducial locations may be used to generate an interpolated polynomial curve (e.g. cubic spline curve), which may then be used to extract a greater number of alignment values, relative to the number of fiducials, from the interpolated curve. By using a large number of alignment values along the printhead, electronic compensation for nozzle misalignments can provide optimized print quality by avoiding large step changes in nozzle firing timing along the length of the printhead.

Typically, each linear inch of the printhead is divided into 10-100 sections, 20-80 sections or 40-60 sections for electronic compensation of nozzle firing timing, with each section having a respective alignment value that may be the same or different from an alignment value corresponding to a neighboring section.

It will be appreciated that the above-mentioned interpolation techniques for generating alignment data are high suitable for electronic compensation of nozzle misalignments by adjusting a timing of nozzle firings within nominal sections of the printhead, which generally do not correspond to mechanically adjustable sections of the printhead. For example, each print chip within one printhead may be divided into, for example, 10-100 sections for the purposes of electronic compensation, whilst only printing, for example, 2-8 fiducials (e.g. 4 fiducials) per print chip.

Preferably, each print chip of the printhead additionally prints an identification code, such as a 2D barcode (e.g. QR code) identifying, inter alia, a respective print chip of the printhead. The identification codes may be printed as a header or a footer of the calibration pattern. Typically, each identification code contains other information useful for subsequent decoding, such as pattern identification, print x resolution, print y resolution, print bars in use, print bar order, reference print bar, printhead identification, page identification, fiducials per print chip, fiducial column width, fiducial row height, fiducial radius, number of rows etc. Redundancy across the printed identification codes enables data to be inferred and the calibration pattern to be decoded, even if one or more identification codes cannot be decoded.

In a second aspect, there is provided a print medium having a calibration pattern printed thereon for generating alignment data for a printhead, the calibration pattern comprising one or more rows of spaced apart fiducials, each fiducial comprising a plurality of concentric shapes representing a Barker code.

In a third aspect, there is provided a processor for generating alignment data for at least one printhead, the processor being configured to perform the steps of:

receiving imaged fiducials at a first resolution, each imaged fiducial comprising a plurality of concentric shapes representing a code sequence;

cross-correlating a template fiducial with the imaged fiducials at a plurality of different displacements relative to each imaged fiducial, the template fiducial having a configuration matching the imaged fiducials;

determining a two-dimensional set of cross-correlation values for each imaged fiducial, each set of cross-correlation values indicating a center of a respective fiducial; and generating alignment data for the printhead using the sets of cross-correlation values.

It will, of course be appreciated that preferred embodiments described in respect of the first aspect will be equally applicable to the second and third aspects, where relevant.

Although the present invention has been developed for use with inkjet printheads, it will be appreciated that the methods, patterns and processors described herein are equally suitable for generating alignment data for other types of printers (e.g. laser printers).

BRIEF DESCRIPTION OF THE DRAWINGS

One or more embodiments of the present invention will now be described with reference to the drawings, in which.

DETAILED DESCRIPTION

Figure 1:
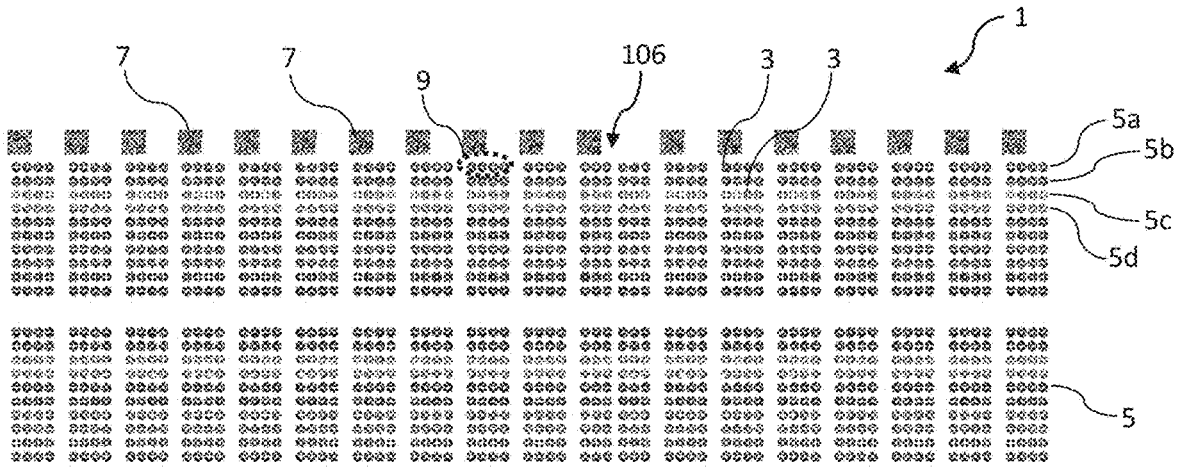
FIG. 1 shows part of a calibration pattern according to the present invention.
Figure 2:
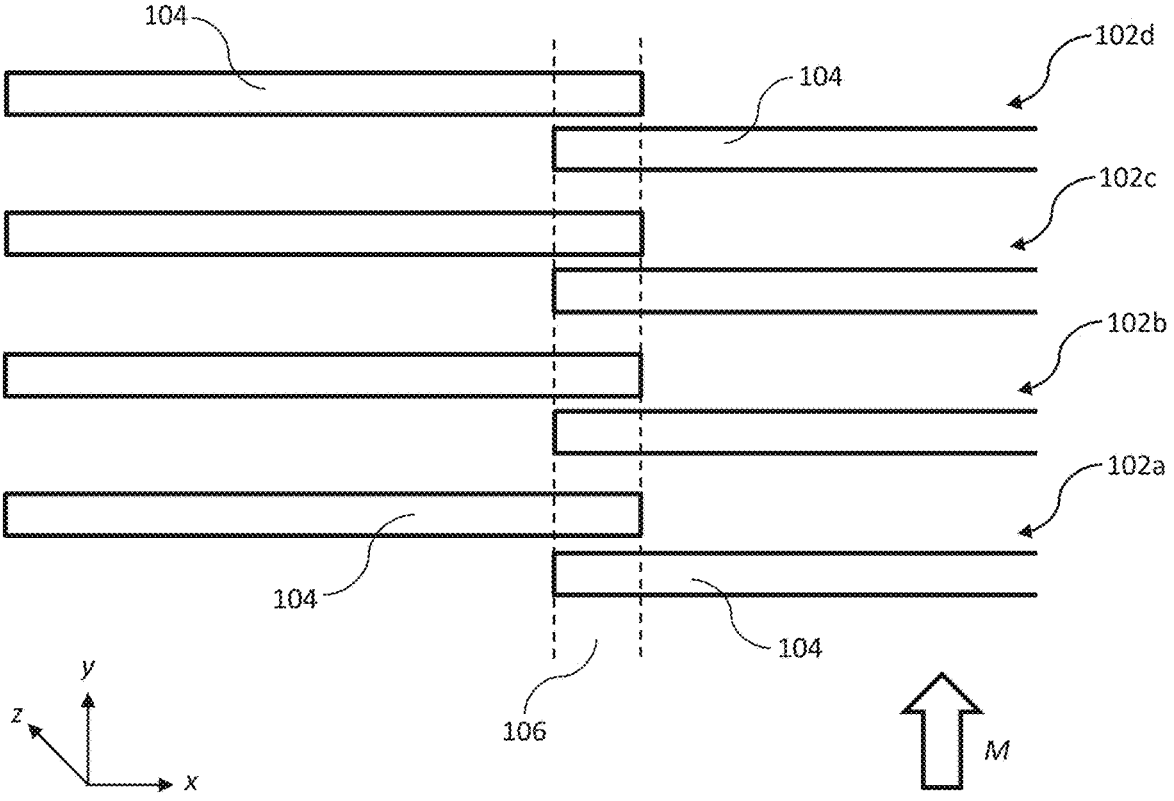
FIG. 2 shows schematically a print system having an array of printheads.

Referring to FIG. 1, there is shown part of a calibration pattern 1 comprising multiple rows of fiducials 3. The calibration pattern 1 is printed by a modular printing system 100 of the type described in detail in US 2017/0313061, and part of which is shown schematically in FIG. 2. The printing system 100 comprises four monochrome print bars 102*a*, 102*b*, 102*c* and 102*d* ejecting black, cyan, magenta and yellow inks, respectively. Each print bar comprises at least first and second print modules ("printheads 104"), which are overlapped across a media width in order to achieve pagewide printing by feeding media past the printheads in a direction indicated by arrow M. The overlapping region between the first and second printheads 104 is referred to as a stitch region 106, in which nozzles from one printhead are stitched with nozzles from an adjacent printhead to provide seamless printing across the stitch region. Various methods of stitching overlapping printheads 104 are known in the art. Typically, overlapping printheads are stitched together using butt stitching, feathered stitching or combinations thereof, as described in, for example, US 2018/0126750, the contents of which are incorporated herein by reference. In FIG. 2, one stitch region 106 is shown for a pair of overlapping printheads 104 in each print bar 102; however, it will of course be appreciated that print bars may comprise N printheads with N−1 stitch regions, where N is an integer from 1 to 20 (e.g. 1 to 12). Likewise, although FIG. 2 shows four aligned print bars 102*a-d* for printing conventional CMYK inks, it will be appreciated that the printing system 100 may comprises M aligned print bars, where M is an integer from 1 to 20 (e.g. 1 to 12) for printing additional inks, such as spot colors, infrared inks, UV inks etc.

Figure 3:
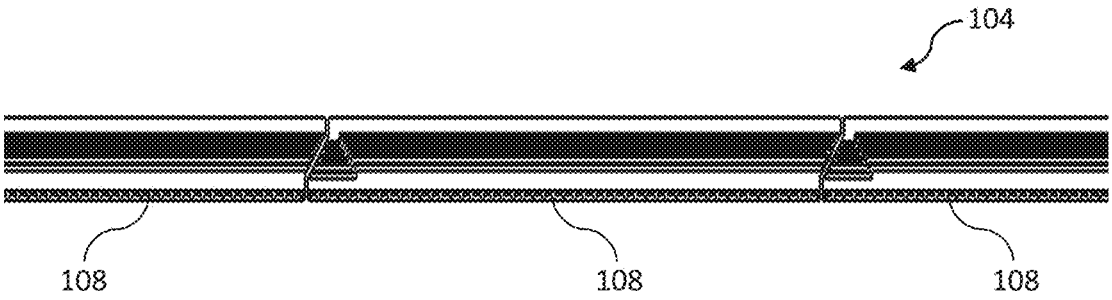
FIG. 3 shows part of a printhead having butting print chips.

In each printhead 104, multiple print chips are arranged to provide seamless printing along a length of the printhead. For example, a Memjet® A4 printhead (as described in U.S. Pat. No. 9,950,527, the contents of which are incorporated herein by reference) contains eleven print chips 108, which are butted together in a single row to provide seamless pagewide printing. FIG. 3 is a magnified view of three butting print chips 108 in a Memjet® printhead. In other types of pagewide printhead (as described in, for example, U.S. Pat. No. 9,168,739, assigned to HP, Inc.), multiple print chips are positioned in a staggered overlapping arrangement to provide pagewide printing.

Figure 4:
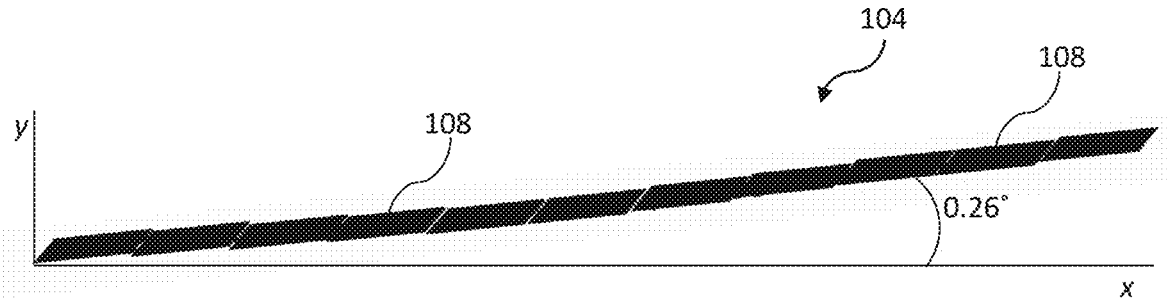
FIG. 4 shows schematically a printhead bowed along its length.

As foreshadowed above, good nozzle alignment is a key requirement for achieving high print quality in pagewide printing systems. However, in the modular printer 100 shown in FIG. 2, it will be appreciated that there are potentially multiple sources of nozzle misalignments: from within each printhead 104; between overlapping printheads in stitch regions 106; and between aligned printheads of different print bars 102. For example, relatively long printheads have a tendency to warp or bow, which may result in significant nozzle misalignments between each end of the printhead 104. FIG. 4 shows schematically the exaggerated effects of printhead warpage, resulting in nozzle misalignments along a nominal x-axis. By way of example only, a warp angle of only 0.26 degrees results in a nozzle misalignment of as much as 1.0 mm in the y-axis for a printhead having a length of 222.2 mm. Due to the multiple sources of misalignments, including skewed print chip placement at the factory, the precise misalignment of each nozzle in each printhead 104 (containing thousands of nozzles in one row) cannot be easily predicted. Nevertheless, with precise data on the misalignment of each nozzle, or group of nozzles, relative to a nominal reference point then any nozzle misalignments may be compensated for by adjusting a timing of nozzle firing (e.g. by delaying or advancing the firing of a group of nozzles by a predetermined number or row times). Thus, the actual source of misalignment is immaterial to the compensation method employed, provided that the control electronics has sufficient alignment data for each printhead 104.

Returning to FIG. 1, the calibration pattern 1 is designed to provide alignment data for predetermined groups of nozzles in each printhead 104 of the printing system 100 in order to enable electronic compensation and, ultimately, optimization of print quality. Providing alignment data at high resolution is necessary, because neighboring nozzles in each print chip 108 are spaced apart by, for example, 15.875 microns in a 1600 dpi printhead. Conversely, a typical optical resolution of an off-the-shelf imaging system (e.g. flatbed scanner) may be about 300 dpi (resolving only an 85 micron pixel separation), which presents a significant challenge for calibrating the printing system 100 using a printed calibration pattern.

As shown in FIG. 1, the fiducials 3 are arranged into multiple rows 5, each row being printed by nozzles of a respective print bar 102. The first four fiducial rows in FIG. 1 are labelled as rows 5*a*, 5*b*, 5*c* and 5*d*, although it will be appreciated that each calibration pattern 1 contains dozens of fiducial rows 5 down the page.

A header portion of the calibration pattern comprises a row of identification codes in the form of 2D barcodes 7 (e.g. QR codes as shown in FIG. 1). Each barcode 7 identifies a respective print chip 108 of a reference printhead 104, together with other information relating to the printing system configuration and the calibration pattern 1.

Each print chip 108 of each printhead 104 prints four fiducials 3, grouped in fiducial sets 9 of the calibration pattern 1, with the exception of those print chips in the stitch region 106, which print only three fiducials each. The black print bar 102*a* serves as a reference print bar and prints the first two rows of fiducials 5*a* and 5*b*, followed by the cyan print bar 102*b* printing the next two rows of fiducials 5*c* and 5*d*. In summary, the fiducial rows 5 follow the sequence: black-black-cyan-cyan-black-black-magenta-magenta-black-black-yellow-yellow and is repeated down the page. In other words, the black fiducial printed by the reference print bar 102*a* interleave each of the colored (CMY) fiducials, enabling alignment of each print bar relative to the reference print bar.

Figure 5:
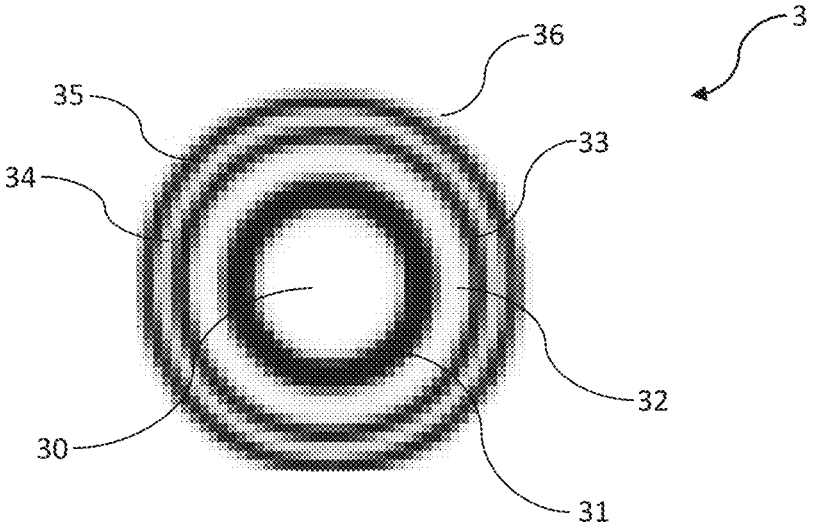
FIG. 5 shows an individual imaged fiducial.

Advantageously, each individual fiducial configuration enables accurate fiducial locations to be determined via optical imaging and decoding, despite the fiducials themselves being relatively large. Referring to FIG. 5, there is shown a captured image of an individual fiducial 3 of the calibration pattern 1 shown in FIG. 1. The fiducial 3 comprises a series of concentric annuli having predetermined ring-widths. Each printed annulus represents one or more code values of the Barker code: [+1, +1, +1, +1, +1, −1, −1, +1, +1, −1, +1, −1, +1]. Thus, the central blank portion 30 of the fiducial 3 represents the first five code values: +1, +1, +1, +1, +1; the innermost printed annulus 31 represents the next two code values: −1, −1; the next outer blank annulus 32 represents next two code values: +1, +1; the next outer printed annulus 33 represents the next code value −1; the next outer blank annulus 34 represents the next code value: +1; the outermost printed annulus 35 represents the penultimate code value: −1; and the outermost blank annulus 36 represents the final code value: +1.

Figure 6:
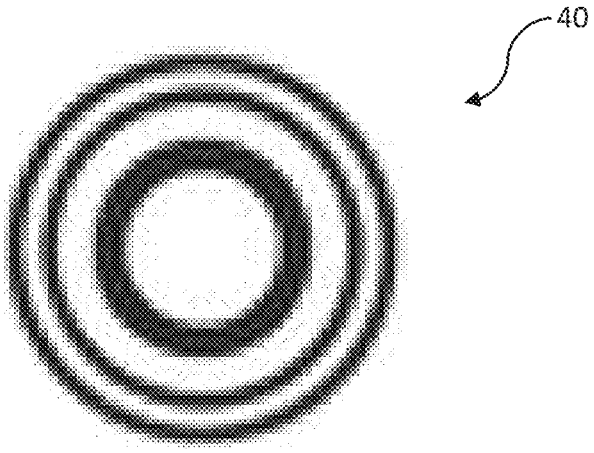
FIG. 6 shows a template fiducial.

As seen in FIG. 5, the imaged fiducial 3 has a large amount of noise in the form of blurred edges, from both the printing and imaging processes. However, Barker codes have characteristically low cross-correlation properties, such that cross-correlation of an electronically-generated template fiducial ("kernel") 40 with each imaged fiducial 3 at a plurality of different displacements yields a centerpoint of each imaged fiducial at the imaging resolution. FIG. 6 shows the template fiducial 40 used for the cross-correlation. The template fiducial 40 is low-pass filtered to simulate the blurred edges of the imaged fiducial 3 so as to optimize the cross-correlation process.

Thus, the use of concentric Barker codes and cross-correlation with a template fiducial 40 means that processing of the calibration pattern 1 is relatively unaffected by noise, as well as being rotationally invariant for the purposes of imaging. In practice, cross-correlation is performed in the frequency domain in order to simplify the required computational analysis and provide a large set of cross-correlation values for each imaged fiducial 3.

Figure 7A:
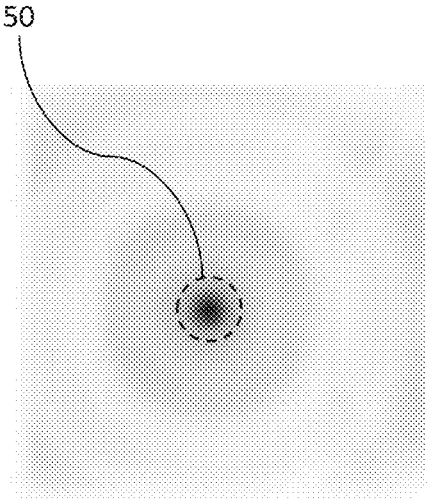
FIG. 7A shows graphically cross-correlation values for an imaged fiducial.
Figure 7B:
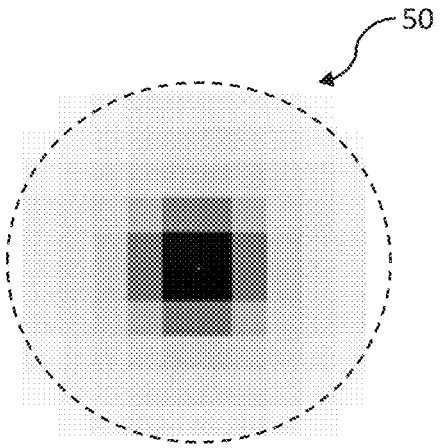
FIG. 7B shows graphically a magnified subset of cross-correlation values.
Figure 8:
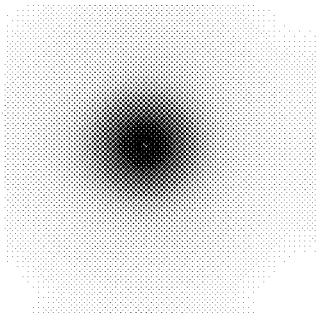
FIG. 8 shows a fiducial location at a second resolution

FIG. 7A shows the results of cross-correlation for an imaged fiducial. The central dark patch 50 graphically represents cross-correlation maxima and indicates a centerpoint location of the fiducial 3 at the imaging resolution (300 dpi). FIG. 7B graphically shows the subset 50 of cross-correlation values in magnified view. Although the cross-correlation process has minimized the effects of noise, the fiducial location has still only been determined to within an accuracy of about 85 microns. In order to further improve the accuracy of the centerpoint location, the subset 50 of cross-correlation values for each imaged fiducial (graphically represented in FIG. 7B) are interpolated using a suitable interpolation technique (e.g. bicubic, nearest neighbour, cubic spline, shape-preserving, biharmonic, thin-plate spline etc.) to determine the centerpoint location of each fiducial 3 at a higher resolution. FIG. 8 shows the centerpoint of an imaged fiducial after interpolation of the subset 50 of cross-correlation values graphically represented in FIG. 7B. After interpolation, each fiducial location is determined to within an accuracy of about 8 microns, which is effectively an imaging resolution of 3175 dpi—more than ten times the original imaging resolution and at a fraction of the cost of an equivalent optical imaging apparatus. Crucially, the fiducial location accuracy is greater than the nozzle pitch of the printhead 104 (about 16 microns), such that the alignment data generated by the calibration pattern 1 and image processing has sufficient accuracy for compensating nozzle misalignments in the printheads 104, notwithstanding the effects of noise in the imaged calibration pattern and a relatively low imaging resolution.

As shown in FIG. 1, each print chip 108 of each printhead 104 prints four fiducials 3 (with the exception of print chips in the stitch region 106). The maximum number of printable fiducials per print chip is determined, to some extent, by the ring-width of the thinnest annuli (i.e. annuli 33 and 35) resolvable by the optical imaging apparatus. For an A4 printhead 104, this provides 43 alignment values per printhead for use in subsequent nozzle misalignment compensation. Further optimization of the calibration process is achievable by interpolating the locations along each fiducial row 5 to generate a continuous smooth curve representing the varying misalignments along the length of an entire print bar 102, which may include multiple printheads 104 and multiple stitch regions 106. Any suitable interpolation technique may be used for this second interpolation step (e.g. bicubic, nearest neighbour, cubic spline, shape-preserving, biharmonic, thin-plate spline etc.), which may be the same or different than the first interpolation technique used on each subset 50 of cross-correlation values.

An advantage of interpolating the fiducial locations along each row 5 in the calibration pattern 1 is that a greater number of alignment values can be generated by sampling the resultant smooth interpolated curve at predetermined intervals in order to improve further the accuracy of misalignment compensation. For example, in a Memjet® print chip of length 20.2 mm containing 1280 nozzles per row, each nozzle row may be divided into 40 sections with each section containing 32 pixels (nozzles). Thus, an alignment value is assigned to each of the 40 sections per print chip (i.e. about 50 sections per inch of printhead), with each alignment value being extracted from the interpolated curve representing the overall warpage of a printhead 104 and/or a print bar 102. A further advantage of assigning an alignment value to a relatively small group of nozzles in each print chip 108 is that large step changes in firing timings are avoided during nozzle misalignment compensation. For example, changes in firing timings may be limited to +1 or −1 timing units between neighboring sections (e.g. 1 timing unit=1 row firing time). By avoiding large step changes in firing timings along a length of the printhead 104 or print bar 102, further optimization of print quality may be achieved.

Returning to FIG. 1, it will be appreciated that accurate locations for each fiducial 3 may be used not only for electronic alignment along a nominal x-axis (i.e. row-wise fiducial analysis across a media width), but also color-to-color alignment of print bars 102*b*, 102*c* and 102*d* relative to a reference (black) print bar 102*a* (i.e. column-wise fiducial analysis along the media feed direction M). Alignment of print bars 102*a-d* for dot-on-dot printing is achieved by using a timing signal from a media encoder and comparing printed fiducial locations down each fiducial column with an expected fiducial location, relative to the reference print bar 102*a*.

In addition, column-wise analysis of fiducials 3 printed from the same print bar (e.g. reference print bar 102*a*) may be used to provide additional alignment data for subsequent processing and compensation.

In summary, it will be appreciated that the calibration pattern 1 and the methods described herein may be used to generate a large amount of alignment data, which can be manipulated to enable compensation of nozzle misalignments in a modular two-dimensional array of printheads 104, such as the modular printing system 100 shown in FIG. 2.

Figure 9:
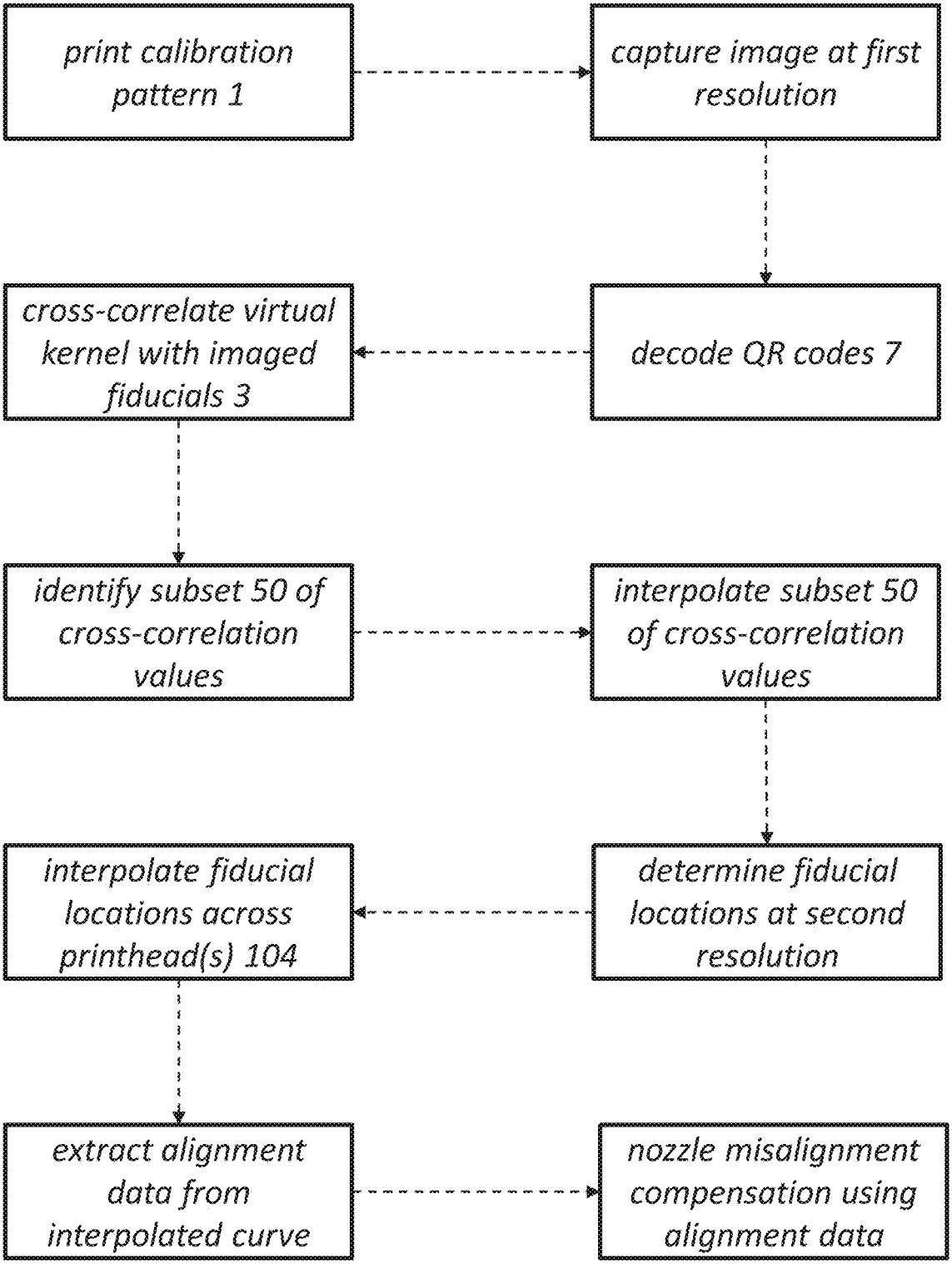
FIG. 9 shows a flow chart for generating alignment data.
Figure 10:
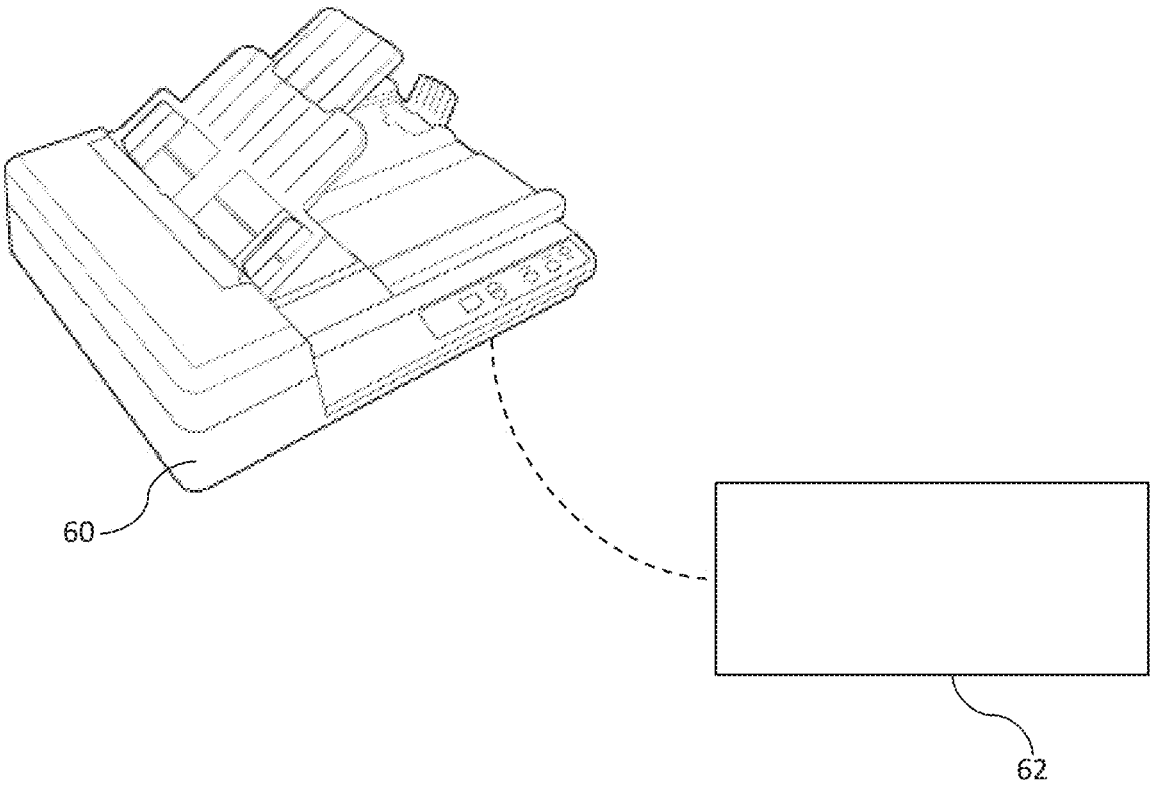
FIG. 10 shows schematically an optical scanner and processor for generating alignment data.

FIG. 9 outlines a basic sequence of steps for generating alignment data in accordance with the method described herein, while FIG. 10 shows schematically an apparatus comprising a flatbed scanner 60 connected to a processor 62 suitable for generating alignment data in accordance with the methods described herein.

The foregoing describes only some embodiments of the present invention, and modifications of detail may be made thereto without departing from the scope of the invention, the embodiments being illustrative and not restrictive.

The invention claimed is:

1. A method of generating alignment data for at least one printhead, the method comprising the steps of:

printing a calibration pattern onto a print medium using the printhead, the calibration pattern comprising one or more rows of spaced apart fiducials, each fiducial comprising a plurality of concentric shapes representing a code sequence;

imaging the fiducials at a first resolution to generate imaged fiducials;

cross-correlating a template fiducial with the imaged fiducials at a plurality of different displacement s relative to each imaged fiducial, the template fiducial having a configuration matching the imaged fiducials;

determining a two-dimensional set of cross-correlation values for each imaged fiducial, each set of cross-correlation values indicating a center of a respective fiducial;

interpolating each set of cross-correlation values to determine one or more rows of locations, each location identifying the center of a respective fiducial at a second resolution; and using each row of locations to generate alignment data for the printhead.

2. The method of claim 1, further comprising the step of: interpolating each row of locations to generate the alignment data.

3. The method of claim 2, wherein the alignment data comprises multiple alignment values extracted from one or more interpolated curves generated by interpolating each row of locations.

4. The method of claim 3, wherein each linear inch of the printhead is divided into at least 10 sections, each section having a respective alignment value.

5. The method of claim 1, wherein each fiducial comprises a plurality of concentric annuli.

6. The method of claim 5, wherein the code sequence has a sequence of N code values, each value being represented by a presence or absence of an annulus at a predetermined distance from a centre of the fiducial, and where N is an integer from 3 to 20.

7. The method of claim 1, wherein the code sequence is a Barker code.

8. The method of claim 7, wherein the code sequence is the Barker code: [+1, +1, +1, +1, +1, −1, −1, +1, +1, −1, +1, −1, +1].

9. The method of claim 8, wherein each code value of +1 is represented by an absence of an annulus and each code value of −1 is represented by a presence of an annulus.

10. The method of claim 1, wherein the second resolution is at least 800 dpi and/or the first resolution is less than 800 dpi.

11. The method of claim 1, wherein the second resolution is greater than a printing resolution of the printhead.

12. The method of claim 1, wherein the first resolution is less than a printing resolution of the printhead.

13. The method of claim 1, wherein the alignment data is used to compensate misalignments of the printhead by adjusting a timing of nozzle firings.

14. The method of claim 13, wherein the calibration pattern is printed using a printing system comprising at least one of:

a plurality of overlapping printheads extending across a pagewidth; and a plurality of printheads arranged along a media feed direction.

15. The method of claim 14, wherein the misalignments are selected from the group consisting of:

misalignments within each printhead;

stitch misalignments between overlapping printheads;

misalignments between printheads arranged along a media feed direction.

16. The method of claim 1, wherein the printhead is comprised of a plurality of print chips, each print chip printing a plurality of fiducials using nozzles from different sections of a respective print chip.

17. The method of claim 16, further comprising the step of printing identification codes onto the print medium, each identification code identifying a respective print chip of the printhead.

18. A processor for generating alignment data for at least one printhead, the processor being configured to perform the steps of:

receiving imaged fiducials at a first resolution, each imaged fiducial comprising a plurality of concentric shapes representing a code sequence;

cross-correlating a template fiducial with the imaged fiducials at a plurality of different displacements relative to each imaged fiducial, the template fiducial having a configuration matching the imaged fiducials;

determining a two-dimensional set of cross-correlation values for each imaged fiducial, each set of cross-correlation values indicating a center of a respective fiducial;

interpolating each set of cross-correlation values to determine one or more rows of locations, each location identifying the center of a respective fiducial at a second resolution; and using each row of locations to generate alignment data for the printhead.

19. A method of generating alignment data for at least one printhead, the method comprising the steps of:

printing a calibration pattern onto a print medium using the printhead, the calibration pattern comprising one or more rows of spaced apart fiducials, each fiducial comprising a plurality of concentric shapes representing a code sequence;

imaging the fiducials at a first resolution to generate imaged fiducials;

cross-correlating a template fiducial with the imaged fiducials at a plurality of different displacement s relative to each imaged fiducial, the template fiducial having a configuration matching the imaged fiducials;

determining a two-dimensional set of cross-correlation values for each imaged fiducial, each set of cross-correlation values indicating a center of a respective fiducial; and generating alignment data for the printhead using the sets of cross-correlation values, wherein:

each fiducial comprises a plurality of concentric annuli; and the code sequence has a sequence of N code values, each value being represented by a presence or absence of an annulus at a predetermined distance from a centre of the fiducial, and where N is an integer from 3 to 20.

* * * * *